United States Patent [19]

Duncan

[11] 4,030,529

[45] June 21, 1977

[54] FILLER TUBE

[75] Inventor: Alexander Ritchie Duncan, Scarborough, Canada

[73] Assignee: The Molson Companies Limited, Spruce Grove, Canada

[22] Filed: Sept. 29, 1975

[21] Appl. No.: 617,493

[30] Foreign Application Priority Data

Nov. 22, 1974 Canada ..... 214443

[52] U.S. Cl. ..... 141/392

[51] Int. Cl.[2] ..... B67C 3/02; B65B 3/04

[58] Field of Search ..... 141/16 S, 392, 286, 141/312, 59, 39

[56] References Cited

UNITED STATES PATENTS 3,742,989 7/1973 Campbell et al. ..... 141/16 S

*Primary Examiner*—Houston S. Bell, Jr.

*Attorney, Agent, or Firm*—Anthony J. Casella

[57] ABSTRACT

This invention relates to a filler tube assembly for use in filling bottles with beverages and in which a movable bottle centering housing has a flared lower end for receiving the tops of the empty bottles and in which the lower distal end of the filler tube is tapered and is provided with a number of circumferentially spaced filling holes.

1 Claim, 2 Drawing Figures

FILLER TUBE

This invention relates to bottle filling machines and in particular to the bottle filling tube assemblies incorporated therewith.

Such assemblies usually consist of a valve adaptor having a depending bottle filling tube whose lower tip is provided with beverage filling apertures, and a bottle centering housing slidably disposed on the tube, all of such parts usually being of metal. In the conventional filling machine, the empty bottles travel around a carousel and, during this time, pass beneath the filling assemblies. In this position, the filling tube of such an assembly commences to enter the bottle and, in consequence, the housing disposes itself about the top of the bottle. Simultaneously, the tube and the adaptor remain stationary and the bottle moves upwardly, whereupon the bottle strikes the top of the housing. Often as not, the hemispherical tips of the filling tubes strike the tops of the bottles and chip or fracture the glass as said tubes attempt to enter the bottles. Repeatedly malfunctioning in this manner also causes damage to said hemispherical tips and in consequence, the filling apertures therein become distorted which thereby affects the filling rate of an assembly. Alternatively, and owing to vibration set up by the high speeds at which such bottle filling machines normally operate, it has been known for the filler tubes to bend when the hemispherical tips strike the rim of the top of the bottle.

It is the object of the present invention to overcome the above disadvantages by providing an improved bottle filling tube assembly.

The invention is illustrated in the accompanying drawings in which

Figure 1:
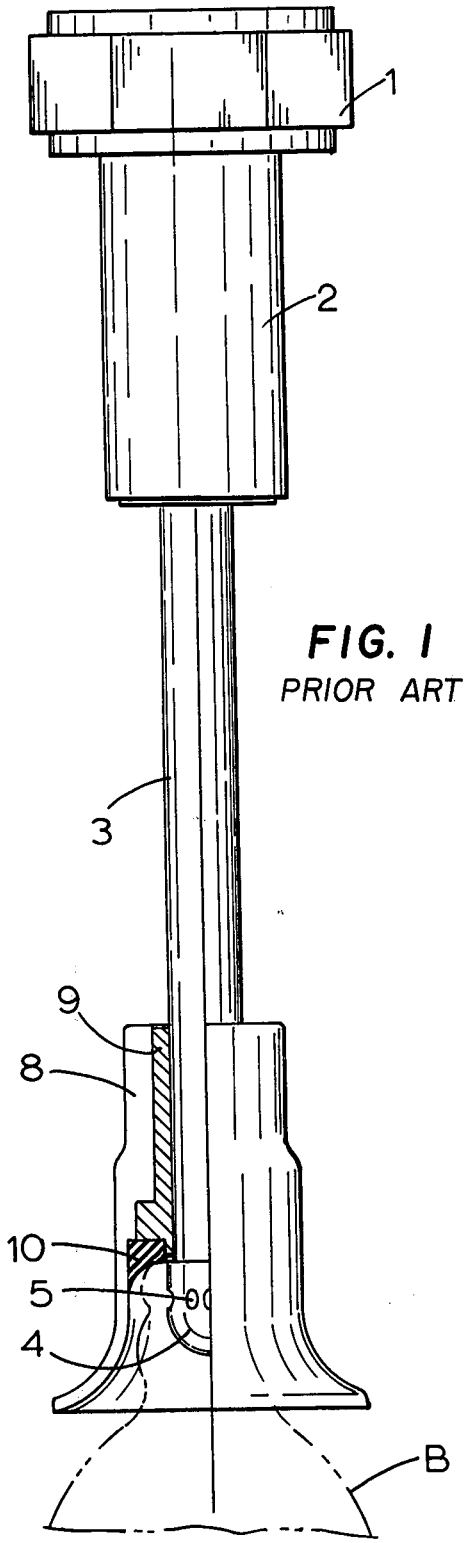
FIG. 1 PRIOR ART
Figure 2:
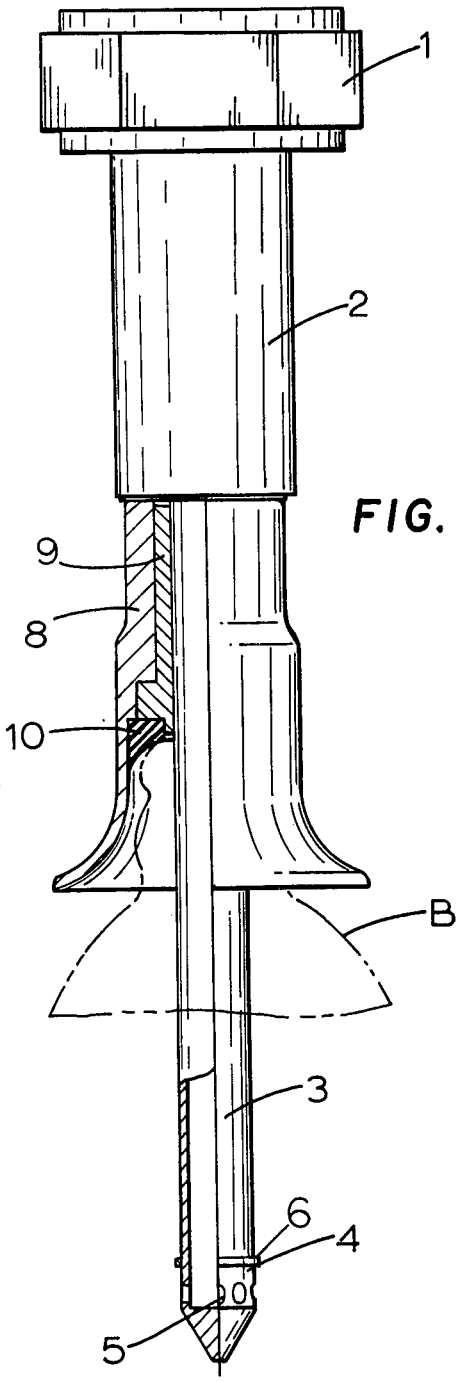

FIG. 1 is a part sectional elevation of a conventional prior art type of filler tube assembly shown in relation to the top of a bottle; and FIG. 2 is a part sectional elevation of the improved filler tube assembly constructed according to the present invention and shown in an operative filling position inserted in a bottle.

Referring to the drawings, and in particular to FIG. 1, the conventional filler tube assembly shown therein is secured in position on the filling machine by means of a large metal nut 1 disposed about the usual valve adaptor 2. The adaptor 2 is centrally bored so as threadingly to receive and retain the upper end of a metal filler tube 3 having an enlarged hemispherical lower tip 4 provided with circumferentially spaced filler holes 5.

Slidably disposed about the filler tube 3 is a metal bell-shaped bottle centering housing 8 which contains a metal bushing 9 the lower end of which has a rubber gasket 10.

In operation, bottles B to be filled with a beverage pass around a carousel located beneath a bottle filling machine. The latter usually consists of a rotatable member having a plurality of circumferentially spaced and depending bottle filling assemblies. Each filling tube of each such assembly commences sequentially to accept an ascending empty bottle, as simultaneously, the associated centering-bell positions itself about the open top of the bottle—such a position being shown in FIG. 1. It will be noted that in the position of the components shown in FIG. 1, the enlarged hemispherical tip 4 of the filler tube 3 serves to limit the amount of downward movement of the bell 8 when the lower terminal end of said bushing 9 contacts the upper terminal end of said tip 4.

As the assembly continues its descent, the filler tube 3 projects into the interior of the bottle still further until all downward movement is prevented when a gasket (not shown) located in the lower end of the adaptor 2 strikes the upper terminal end of the bell 8.

Repeated contact of the bottle with the lower end of the hemispherical tip 4 tends to bend the latter out of its normal vertical axis so that, in time, said tip then commences to strike the upper end of the bottle. This not only causes fracture of the glass but also bending of the filler tube.

The improved filler tube assembly is shown in FIG. 2 where, insofar as possible, like references have been utilized.

As will be seen from FIG. 2, the lower end of the tube 3 is provided with a tip 4 which is tapered at substantially 30° to the vertical axis of said tube. This has the advantage of guiding the tube into the bottle B in a more positive manner than heretofore thereby inhibiting chipping of the top of the bottle, adjacent the open mouth thereof, and also avoiding bending of the tube 3.

A collar 6 is disposed about the tube 3, adjacent the upper end of the tapered tip 4 and it is this collar that is contacted by the lower end of the bushing 9. By arranging for the bushing to contact the collar, as opposed to striking the upper end of the tip itself, vertical axial misalignment of the integers is inhibited.

The collar 6 is fixedly disposed on the tube 3 adjacent the upper terminal end of the tip 4, and the diameter of the collar is greater than the diameter of the tube as well as that of the upper terminal end of the tip whereby the collar acts as a stop limiting the amount of downward movement of the housing 3.

I claim: the

1. A bottle filler tube assembly including a valve adaptor serving as the mounting for the upper end of an axially bored liquid filling tube of elongated tubular configuration, a downwardly and outwardly flared bottle centering housing slidably mounted on said tube, a gasket within said housing adapted to contact the upper end of a bottle to be filled, the tip of said tube being closed and tapered at 30° to the longitudinal axis of said tube, the lower end of said tube having a plurality of cirumferentially unobstructed spaced filler holes and a collar fixedly disposed on said tube adjacent the upper terminal end of said tip, the diameter of said collar being greater than the diameter of said tube and that of the upper terminal end of said tip whereby said collar acts as a stop limiting the amount of downward movement of said housing.

* * * * *